US006953159B2

(12) United States Patent
Laidler

(10) Patent No.: US 6,953,159 B2
(45) Date of Patent: Oct. 11, 2005

(54) SPRAY THROUGH CAP ASSEMBLY WITH ACTUATOR LOCKING MEANS

(75) Inventor: Keith Laidler, Stourbridge (GB)

(73) Assignee: Incro Limited, Stourbridge (GB)

( * ) Notice: Subject to any disclaimer, the term of this patent is extended or adjusted under 35 U.S.C. 154(b) by 176 days.

(21) Appl. No.: 10/344,127

(22) PCT Filed: Aug. 21, 2001

(86) PCT No.: PCT/GB01/03765

§ 371 (c)(1),
(2), (4) Date: Feb. 7, 2003

(87) PCT Pub. No.: WO02/16226

PCT Pub. Date: Feb. 28, 2002

(65) Prior Publication Data

US 2003/0164407 A1 Sep. 4, 2003

(30) Foreign Application Priority Data

Aug. 22, 2000 (GB) ..... 0020619

(51) Int. Cl.[7] ..... B05B 1/28; B05B 1/32; B05B 7/32

(52) U.S. Cl. ..... 239/104; 239/106; 239/600; 239/451; 239/455; 239/337

(58) Field of Search ..... 239/104, 600, 239/337, 342, 359, 360, 451, 455, 123, 106; 222/148, 402.1, 402.13; 220/254.1–254.9, 255, 345.5

(56) References Cited

U.S. PATENT DOCUMENTS 3,894,665 A 7/1975 Swenson
4,773,562 A * 9/1988 Gueret ..... 222/135
5,927,604 A * 7/1999 Laidler ..... 239/104

FOREIGN PATENT DOCUMENTS

WO WO 97/31841 9/1997

* cited by examiner

*Primary Examiner*—David A. Scherbel
*Assistant Examiner*—Seth Barney
(74) *Attorney, Agent, or Firm*—Pillsbury Winthrop Shaw Pittman LLP

(57) ABSTRACT

An improved spray through cap assembly (10) comprises separable base (11) and cover parts (13). The base part includes a hollow actuator (17) which is adapted to cooperate with an outlet of an aerosol or the like. The actuator is linked to a fluid flow channel (19) formed by correspond recesses in the base and cover parts, respectively, and a nozzle outlet (20). Depressing the cover part causes the actuator to actuate the outlet and causes the contents of the aerosol to be discharged through the nozzle outlet via the fluid flow channel. In order prevent accidental discharge, in one embodiment, the base part includes a projecting lip (22) and the cover part includes a nose (21), the lip and nose cooperating in an inoperative position to prevent the actuator actuating the outlet. In a further embodiment, the cover part is formed from two separable parts and the fluid flow channel and nozzle outlet are formed by corresponding recesses in the parts of the cover parts. In this embodiment, the cover part and base part can be separated prior to separating the respective parts of the cover part for cleaning, thereby also preventing accidental discharge on cleaning.

17 Claims, 2 Drawing Sheets

SPRAY THROUGH CAP ASSEMBLY WITH ACTUATOR LOCKING MEANS

CROSS-REFERENCE TO RELATED APPLICATION

This application is a national phase application based on International Application No. PCT/GB01/03765, filed Aug. 21, 2001. This application, in its entirety, is incorporated herein by reference.

This invention relates to an improved spray through cap assembly of the kind which includes a nozzle arrangement and a nozzle outlet.

A spray through cap assembly is conventionally used to close off the top of air freshener containers or other containers which contain contents which are dispensed from a container outlet under pressure. The spray through cap assembly usually comprises an actuator part which is adapted to be capable of actuating engagement with the outlet of the container and an actuator which is operatively linked to the actuator part. When the actuator of the spray through assembly is actuated by a user, the actuator part actuates the outlet of the container allowing the contents of the container to pass under pressure from the container through the nozzle arrangement in the spray through cap to be discharged through the nozzle outlet. The spray through cap assembly is usually formed as two separate but connected parts which can be separated to allow cleaning of an interior of the nozzle arrangement.

Problems have arisen through the use of spray through caps as actuators for containers which contain toxic or other harmful substances since it is possible to actuate the spray through cap by pressing the actuator accidentally causing discharge of the contents of the container. Thus, for example, if a child handles the container, accidental discharge can occur. The discharge of the contents of the container can, if the container is so oriented, be into a person's face which could obviously cause serious injury. Furthermore simply being able to cause the discharge the contents means if these products are harmful or toxic, the health of a person could be seriously at risk.

Accordingly, it is a first object of the present invention to provide a spray through cap assembly in which it is possible to eliminate the possibility of accidental discharge of the contents of the container.

Problems have also arisen through the fact that when separating the parts of the assembly for cleaning, it is also possible to cause accidental actuation of the actuator which can cause discharge of the contents of a container into a persons face.

Accordingly, it is a second object of the present invention to provide a spray through cap assembly in which, separation can occur for cleaning without accidental discharge of the container contents.

Thus and in accordance with a first aspect of the present invention therefore there is provided an improved spray through cap assembly incorporating a nozzle arrangement having a nozzle outlet thereto, said assembly including an actuator member adapted for actuating engagement with an outlet of a container containing contents under pressure and an actuator which upon operation by a user causes said actuation member to actuate said container outlet to discharge said contents into said nozzle arrangement and from said nozzle outlet, wherein at least a part of said assembly is moveable between operative and inoperative positions, wherein in said operative position the actuator member is disposed in a position whereby actuation of the actuator causes actuating engagement of the actuator member with a container outlet and in said inoperative position said actuator member is disposed in such a position that actuation of the actuator does not cause actuating engagement of said actuator member with said container outlet.

With this arrangement it is possible to provide a spray through cap assembly in which accidental discharge can be eliminated.

In accordance with a second aspect of the present invention therefore there is provided an improved spray through cap assembly incorporating a nozzle arrangement having a nozzle outlet thereto, said assembly including an actuator member adapted for actuating engagement with an outlet of a container containing contents under pressure and an actuator which upon operation by a user causes said actuation member to actuate said container outlet to discharge said contents into said nozzle arrangement and from said nozzle outlet, wherein said assembly is formed as releasably connected parts which are movable towards and away from each other, at least one of said parts comprising said nozzle arrangement and said actuator member and being formed by at least two interconnected parts which are separable for cleaning.

With this arrangement it will be appreciated that separation of parts of nozzle arrangement for cleaning can occur after movement of the actuator away from the container outlet thereby obviating the chances of accidental discharge during cleaning.

The invention will now be described further by way of example only and with reference to the accompanying drawings in which.

Figure 1:
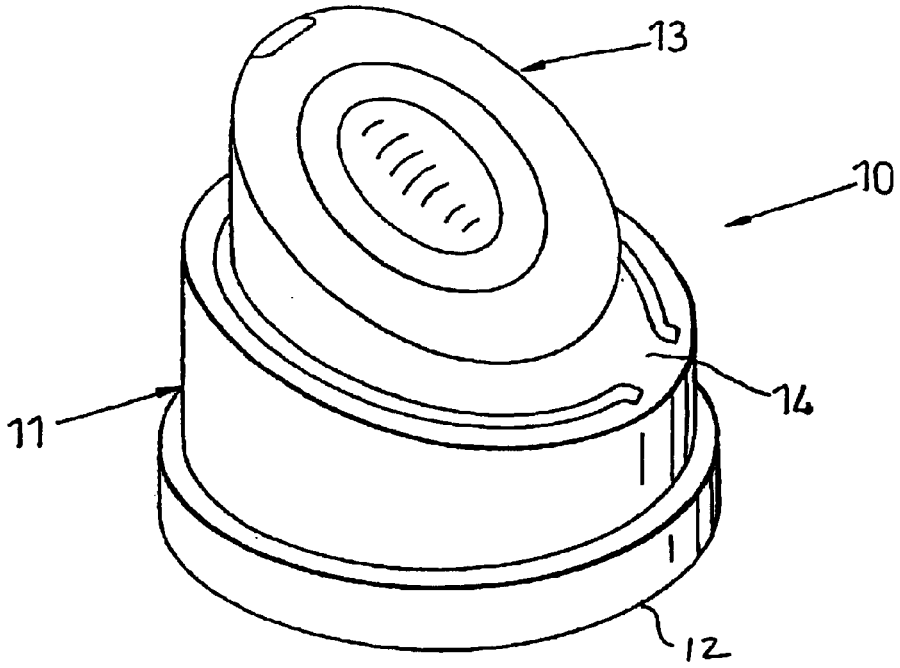
FIG. 1 is a perspective view of one form of spray through cap assembly according to the first aspect of the invention.

Referring now to the Figures there is shown in FIG. 1 one form of spray through cap assembly according to the first aspect of the present invention.

The spray through cap assembly 10 comprises a base part 11 which is adapted at a bottom 12 thereof for engagement with the top of a canister (not shown) containing contents under pressure and a cover part 13 which is attached to the base part 11 by way of a resilient hinge 14. The base part 11 and cover part 13 are adapted for releasable engagement with each other. The base part 11 and cover part 13 and hinge 14 can be formed integrally with the assembly or can be attached thereto as separate parts. The spray through cap assembly includes a nozzle arrangement 16 (see FIG. 2) which is formed by a hollow actuator member 17 which extends downwardly from a top 18 of the base 11 into the interior of the base and a fluid flow channel 19, which is provided in fluid flow connection with the interior of the actuator member 17, and which terminates in a nozzle outlet 20. In this embodiment the base part 11 and cover part 13 have cooperating recesses thereon which terminate in open ends at a edge of the respective parts 11 and 13. When the base 11 and cover 13 are releasably engaged the cooperating recesses define the fluid flow channel 19 and the open ends cooperate to form the nozzle outlet 20. The cover 13 includes a downwardly projecting nose 21 which is adapted for releasable co-operation with a lip 22 provided on the base part 11. Alternatively the projecting nose 21 can be provided on the base 11 and the lip 22 on the cover part 13. A top surface of the cover 13 includes protruding ribs 28 over at least a part thereof which facilitate positive contact during actuation of the spray through cap assembly.

At least the base 11 of the spray through cap is formed from a flexible material preferably a plastics material such that side walls 29 (FIG. 2) of the spray through cap assembly can be deformed by applying pressure thereto.

In use, the spray through cap assembly engages the top of a conventional aerosol can which contains contents under pressure. Once engaged with the top of the container, the actuator 17 is disposed in close proximity to the outlet of the container.

Figure 2:
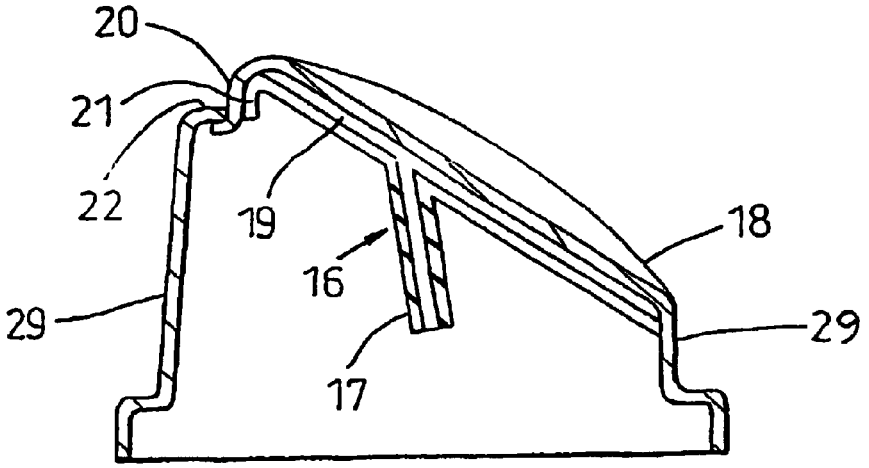
FIG. 2 is a sectional side view of the cap of FIG. 1.
Figure 3:
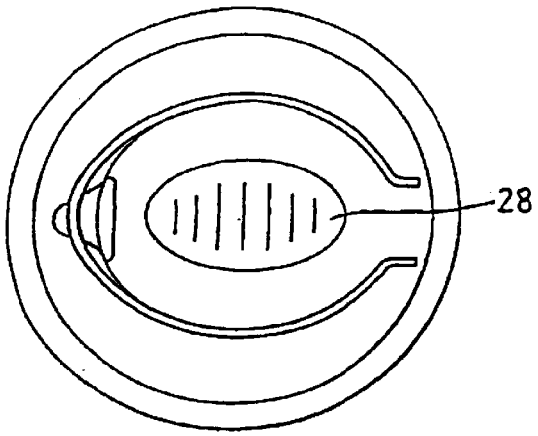
FIG. 3 is a top view of the cap of FIG. 1.
Figure 4:
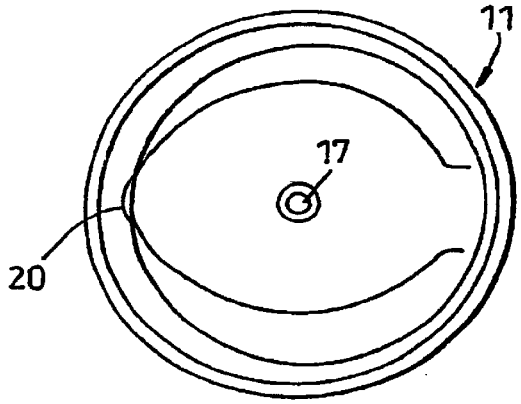
FIG. 4 is an underneath plan view of the cap of FIG. 1.

Referring now to FIG. 2. it can be seen that when the cover 13 is releasably engaged with the base 11, the projecting nose 21 on the cover can engage under the lip 22 on the base part 11 thereby retaining the cover 13 in a closed position. In this position, it is arranged that the actuator member 17 is disposed in a position such that, if the top of the cover 13 is depressed by a user, the actuator member 17 engages with the outlet of the canister to actuate the same and cause the contents of the canister to be discharged through the interior of the actuator member 17, the fluid flow channel 19 and the nozzle outlet 20. If the projecting nose 21 is released from under the lip 22 on the base 11 by applying pressure to the side walls 29 of the base 11 then it will be appreciated that the projecting nose 21 will be positioned such that it engages on top of the projecting lip 22. In these circumstances, it will be arranged that with the nose 21 in this position the actuator member 17 will be positioned so as to be spaced from the outlet of the container such that if the cover 13, is depressed, movement of the cover 13 is restricted by engagement of the nose 21 on top of the lip 22 and therefore the actuator will not actuate the outlet of the container and thereby the discharge of the contents under pressure into the interior of the actuator 17 is prevented. In order to render the spray through cap operable once again, the side walls 29 of the base 11 must have pressure applied thereto and the projecting nose 21 must be positioned once again under the projecting lip 22 as shown in FIG. 2.

With this arrangement, it will be appreciated that it is possible to prevent accidental actuation of the container, if the container is supplied with the projecting nose 21 on the cover 13 resting on top of the projecting lip 22 of the base. In this configuration the spray through cap assembly is inoperable and therefore if picked up for example by a child or other person there will be no accidental discharge of the contents of the container.

It will be appreciated that with the arrangement of the present invention it is possible to provide a spray through cap assembly in which accidental discharge is eliminated and furthermore, since the operation of rendering the spray through cap operable is quite a difficult one, this renders the arrangement childproof.

Figure 5:
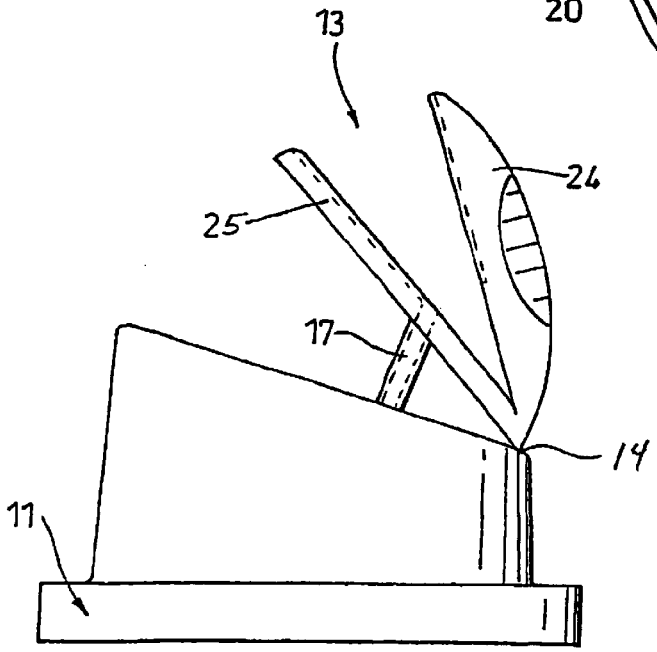
FIG. 5 is a side view of one form of spray through cap assembly according to the second aspect of the invention.

A spray through cap assembly of the second aspect of the invention is shown in FIG. 5. In this assembly the cover 13 is formed from two separate 15 upper and lower cover parts 24, 25 which are releasably engageable with each other and which can be separated for cleaning purposes.

The upper and lower cover parts 24, 25 have corresponding recesses therein which terminate in open ends at the edge of the cover part 13, wherein when the cover parts 24, 25 are releasably engaged, the respective recesses co-operate to form the fluid flow channel 19 and the open ends cooperate to form a nozzle outlet 20. The cover parts 24, 25 may be formed separately or may be interconnected. Furthermore, the cover parts 24, 25 may be formed integrally with the assembly or way be releasably attached thereto. In a preferred construction, the cover parts 24, 25 are attached to the base 11 by way of respective resilient hinges. The actuating member 17 depends from the lower cover part 25 and when the cover parts 24, 25 are engaged, the hollow interior of the actuating member 17 is in fluid flow connection with the fluid flow channel 19 and nozzle outlet 20.

If utilised in this embodiment, which is not essential, the projecting nose 21 can he provided on the upper cover part 24 or lower cover part 25 and the projecting lip 22 on the base part 11, or vice versa, as in the previous embodiment. Alternatively any other suitable locking arrangement to lock said cover parts 24, 25 in relation to the base part 11 so as to prevent actuation can be utilised as desired or as appropriate.

It will be appreciated that with this arrangement, the cleaning of the nozzle arrangement can be effected by separating the two cover parts 24, 25 and cleaning the recesses. Furthermore, as separation of the cover parts 24, 25 can take place after the cover 13 has been moved away from the base part 11, there is no possibility of accidental actuation of the container. This is further facilitated by the fact that the cover 13 can be pivoted through 180° by virtue of resilient hinge 14 which means that separation of the cover parts 24, 25 can take place after such pivoting thereby ensuring that, upon separation of the cover parts 24, 25 for cleaning, accidental actuation does not rake place. Alternatively, the cover part 13 can be arranged to be removable from the assembly at least partially or completely whereby separation of cover parts 24, 25 can take place after removal.

As a further alternative, the lower cover part 23 may be releasably engageable with the base part 11. In these circumstances, one of the nose 21 and lip 22 can be provided respectively on the base 11 and upper cover part 24 respectively whereby the engagement of the nose 21 and lip 22 when in the inoperative positions, can prevent the actuator part on the cover part 25 being bought into contact with the outlet of the container when the actuator on the upper cover part 24 is actuated. This means that the upper part 24 can be separated from the lower part 25 when in the inoperative positions, for cleaning without the probability of accidental discharge of the contents of the container.

It is of course to be understood that the invention is not intended to be restricted to the details of the above embodiment which are described by way of example only.

What is claimed is:

1. A spray-through cap assembly incorporating a nozzle arrangement having a nozzle outlet thereto, said assembly comprising an actuator member adapted for actuating engagement with an outlet of a container containing contents under pressure; an actuator which upon operation by a user causes said actuator member to actuate the discharge of said contents from said outlet of said container into said nozzle arrangement and through said nozzle outlet; said assembly comprising a base part and a cover part, said cover part being releasably connectable to said base part further comprising said nozzle arrangement and said actuator member, wherein said cover part is formed by at least two releasably connectable parts which are separable from each other for cleaning.

2. A spray-through cap assembly according to claim 1, wherein said cover part is integrally formed with said base part.

3. A spray-through cap assembly according to claim 1, wherein said cover part is connected to said base by a resilient hinge.

4. A spray-through cap assembly according to claim 3, wherein the resilient hinge facilitates the pivoting of the base and the cover parts relative to each other through at least 180°.

5. A spray-through cap assembly according to claim 1, wherein said at least two releasably connectable parts of said cover part are an upper part and a lower part.

6. A spray-through cap assembly according to claim 5, wherein said upper and lower parts are separate.

7. A spray-through cap assembly according to claim 5, wherein said upper and lower parts are interconnected.

8. A spray-through cap assembly according to claim 7, wherein said upper and lower cover parts are connected to the base part by way of respective resilient hinges.

9. A spray through cap assembly according to claim 5, wherein the actuating member depends from the lower cover part and, when said upper and lower parts are releasably engaged, said upper and lower parts have corresponding recesses therein which cooperate to form a fluid flow channel which provides a fluid flow connection between the actuator member and the nozzle outlet.

10. A spray-through cap assembly according to claim 5, wherein a locking arrangement is provided to lock the cover part in relation to the base part to prevent the accidental actuation of the nozzle while the upper and lower parts are separated for cleaning.

11. A spray-through cap assembly according to claim 10, wherein said lock is formed by a base part that comprises a nose which engages with a corresponding lip on the upper or lower cover part.

12. A spray-through cap assembly according to claim 10, wherein said lock is formed by an upper or lower cover part that comprises a nose which engages with a corresponding lip on the base part.

13. A spray-through cap assembly according to claim 5, wherein said lower part is releasably engageable with said base part and said upper part is separable from said lower part when it is engaged with said base to facilitate cleaning.

14. A spray-through cap assembly according to claim 13, wherein said upper part comprises a lip which engages with a nose on said base part to lock the upper cover part relative to the base part to enable cleaning without the possibility of accidentally actuating the assembly.

15. A method of cleaning a spray-through cap assembly as claimed in claim 5, said method comprising the steps of separating said cover parts from said base part and then separating said upper and lower cover parts for cleaning.

16. A method of cleaning a spray-through cap assembly as claimed in claim 13, said method comprising the step of separating said upper cover part from said lower cover part.

17. A spray-through cap assembly incorporating a nozzle arrangement having a nozzle outlet thereto, said assembly comprising an actuator member adapted for actuating engagement with an outlet of a container containing contents under pressure; an actuator which upon operation by a user causes said actuator member to actuate the discharge of said contents from said outlet of said container into said nozzle arrangement and through said nozzle outlet; said assembly comprising a base part and a cover part, said cover part being releasably connectable to said base part and further comprising said nozzle arrangement and said actuator member, wherein said cover part is formed by at least two releasably engageable parts which are unengageable from each other for cleaning.

* * * * *